US005429366A

United States Patent [19]

McCabe

[11] Patent Number: 5,429,366

[45] Date of Patent: Jul. 4, 1995

[54] GOLF CLUB SIGHTING SYSTEM AND METHOD

[75] Inventor: Terrill R. McCabe, West Chester, Ohio

[73] Assignee: Sceptre Golf Company, Vista, Calif.

[21] Appl. No.: 98,475

[22] Filed: Jul. 27, 1993

[51] Int. Cl.[6] ..... A63B 69/36

[52] U.S. Cl. ..... 273/187.4; 273/164.1; 273/167 H

[58] Field of Search ..... 273/187.4, 187.6, 164.1, 273/171, 186.2, 167 H

[56] References Cited

U.S. PATENT DOCUMENTS

| | | | |
|---|---|---|---|
| D. 244,557 | 5/1977 | Parkoma | D34/5 |
| 2,517,245 | 8/1950 | Scott | 273/171 |
| 3,548,504 | 12/1970 | Sykes | 33/46 |
| 3,826,495 | 7/1974 | Elkins | 273/32 R |
| 3,880,430 | 4/1975 | McCabe | 273/167 A X |
| 4,340,229 | 7/1982 | Stuff | 273/164 |
| 4,367,877 | 1/1983 | Gibson et al. | 273/164 |
| 4,458,900 | 7/1984 | Antonious | 273/164 |
| 4,530,505 | 7/1985 | Stuff | 273/164 |
| 4,708,346 | 11/1987 | Pierce et al. | 273/164 |
| 4,749,196 | 6/1988 | Podgor | 273/164 |
| 4,809,977 | 3/1989 | Doran et al. | 273/77 A |
| 4,809,984 | 3/1989 | Tindale | 273/192 X |
| 5,169,150 | 12/1992 | Tindale | 273/187.4 |

FOREIGN PATENT DOCUMENTS

| | | | |
|---|---|---|---|
| 324501 | 1/1930 | United Kingdom | 273/164.1 |

OTHER PUBLICATIONS

Aug. 1971 issue of Gold Digest, article entitled "The Search for the Perfect Putter", by Dick Aultman, pp. 36–40 and 45.

*Primary Examiner*—George J. Marlo
*Attorney, Agent, or Firm*—Baker & Daniels

[57] ABSTRACT

The present invention provides a sight corrected golf club which includes a golf head and a module bearing an alignment indicia thereon. The golf head has a region adapted for receiving the module which is preferably secured to the golf head at the time the golf club is sold to an ultimate purchaser.

9 Claims, 3 Drawing Sheets

GOLF CLUB SIGHTING SYSTEM AND METHOD

TECHNICAL FIELD

This invention is directed to an improvement in a golf club of the type which includes a sighting line inscribed or otherwise marked thereon to assist the golfer in aligning the golf club before striking a ball towards a hole or pin. In particular, the present invention relates to a method and apparatus for positioning the sight line vis-a-vis the ball striking surface of the club head, preferably in accordance with the particular requirements of a given golfer.

BACKGROUND OF THE INVENTION

It is well known, of course, that human sight is not perfect. Indeed, golfers can have many different sight-related problems when trying to align a golf club vis-a-vis a golf ball for the purpose of striking the golf ball into a cup. A golfer's sighting errors cause the golfer to aim incorrectly when taking a swing at a golf ball.

In the prior art, many techniques have been tried to aid golfers in aligning their golf clubs in order to strike a golf ball into a golf cup. See, for example, my prior U.S. Pat. No. 3,880,430 which proposed using a number of indicia at different levels in order to try to compensate for the sighting error of a golfer. In my prior U.S. patent, I used a sighting line which was aligned exactly perpendicular to the ball-striking face of the club.

Others recognized that one way of compensating for human sighting errors was to place the sighting line at some angle, other than perpendicular, to the ball-striking surface. See, for example the disclosure of U.S. Pat. No. 3,826,495 to Elkins, the disclosure of which is hereby incorporated herein by reference. The method and apparatus disclosed by Elkins sufferers from a number of drawbacks. One drawback of the Elkins device is that each club head is inscribed with a corrected sighting line and if a golf-pro shop or other store for selling golfing equipment is to carry a reasonable selection of goods, the fact that any given golf head can have a large number of possible sight correction lines associated with it, causes stocking problems for golf clubs to increase manyfold. The present invention overcomes this difficulty in that the sighting line on the golf club may be adjusted, in accordance with the needs of a particular golfer, at the time the golf club is sold to the golfer. A further drawback of the Elkins device is that it is limited to a golf club head with a broad top surface. The present invention overcomes this difficulty by allowing the corrected sighting line to be applied to a wide variety of club head shapes.

DETAILED DESCRIPTION

The present invention relates to an apparatus and method for equipping a golf club with a sight alignment indicia, preferably at the time the golf club is sold to a consumer. Although the invention is described in detail herein with respect to a golf club putter, those skilled in the art will realize that the present invention could be used with other types of golf clubs, such as metal woods, etc.

Brief Description of the Drawings

FIG. 10(*c*) is a top view of the alignment disk used with the embodiment of FIGS. 9(*a*)–9(*c*);

First Embodiment of the Invention

Figure 1:
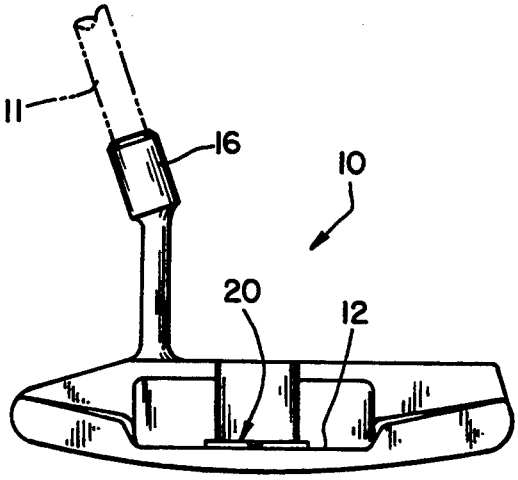
FIG. 1 is a rear elevational view of a golf club putter embodying the present invention.
Figure 2:
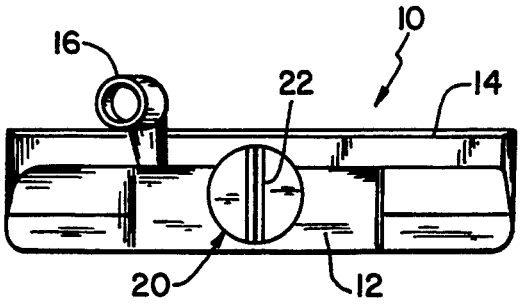
FIG. 2 is a plan view of the putter of FIG. 1.
Figure 3:
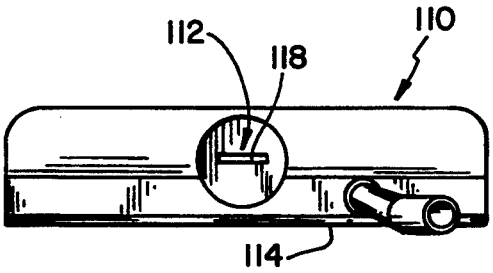
FIG. 3 is a plan view of a golf club putter in accordance with the second embodiment of the present invention.
Figure 4:
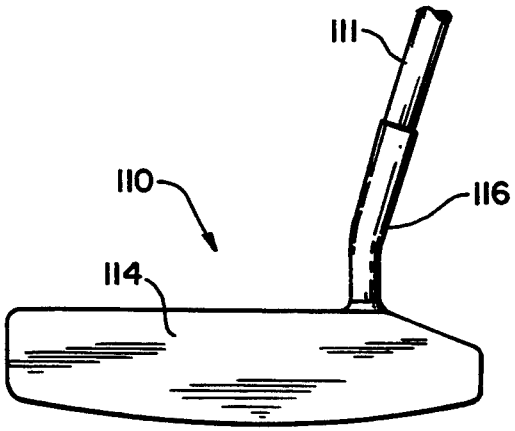
FIG. 4 is a front elevational view of the golf club putter head of FIG. 3.
Figure 5:
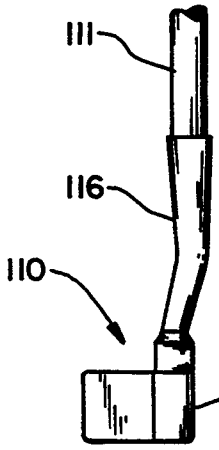
FIG. 5 is a side elevational view of the golf club putter of FIG. 3.
Figure 6:
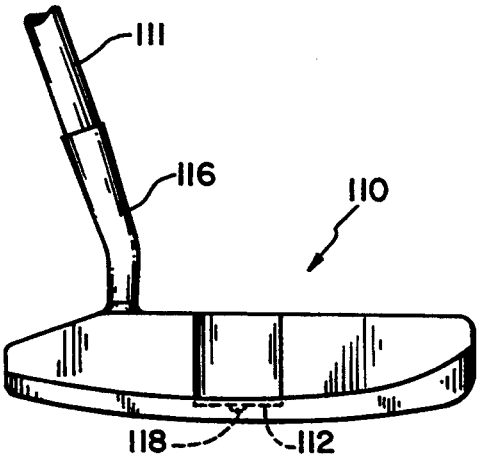
FIG. 6 is a rear elevational view of the golf club putter head of FIG. 3.

A first embodiment of the invention is shown in FIGS. 1 and 2. FIG. 1 is a rear elevational view of a putter head 10 while FIG. 2 is plan view of the putter head 10. The putter head is typically attached at hosel 116 to a golf club shaft 11 of which shaft is partially depicted (in phantom lines) in FIG. 1.

The putter head 10 has a relatively flat surface 12 extending rearwardly from the ball-striking face 14 of the putter. A disk 20 is provided which has a sight line 22 inscribed or otherwise marked thereon. The disk is mounted on surface 12. The sighting line 22 would usually be disposed at some angle from the perpendicular to face 14 (in plan view). The particular angle by which line 22 would deviate from the perpendicular in (plan view) would correspond to that which is needed to compensate for the golfer's sighting error. The disk 20 is secured to surface 12 by means of a suitable adhesive medium, and preferably by a double-sided adhesive tape manufactured by 3M Incorporated under the name Scotch TM brand VHB TM adhesive transfer tape, at the time the golf club is sold to a customer, for example, at a golf-pro shop. Alternatively, disk 20 can be affixed by suitable means at the time the golf club is manufactured. I prefer to practice this invention by having disk 20 affixed at the point of sale since that reduces the need for a seller (e.g., a golf-pro shop) to stock a large number of clubs having different correction factors associated with sight lines 22. When the invention is practiced as I suggest, it should have greater market acceptance since the stocking needs of the seller are reduced. I realize, however, that others may deem it preferable to install disks 20 at the point of manufacture, rather than at the point of sale.

While the design shown in FIGS. 1 and 2 results in a rather simple but elegant golf head, it does have certain drawbacks.

Golf clubs in general, and perhaps putters in particular, tend to be rather expensive implements. If a golfer is to purchase a new putter, for example, with an alignment indicia incorporated into it, the golfer will most likely want to be satisfied that the alignment indicia is correctly oriented so as to improve the golfer's alignment or playing capabilities. This will often involve testing the golf club in question and one of the drawbacks associated with the embodiment of FIGS. 1 and 2 is that disk 20 is not particularly easily affixed temporarily to the golf head for testing purposes. If it is not at least temporarily affixed, it would likely come flying off surface 12 when the golf club was used, if not earlier. If it is securely fastened to surface 12, then that makes it rather difficult to either return the golf club to stock if it is not purchased, or to alter the angle which sighting line 22 makes with respect to the face 14 of the golf club, should it need adjustment. The second and third embodiments address this difficulty.

Second Embodiment of the Invention

A second embodiment of the invention will now be described wherein a disk 20 bearing the sighting indicia 22 may be temporarily installed and held in place on the golf club for the purpose of testing the golf club and subsequently is affixed to the golf club when a sale is consummated.

Figure 7A:
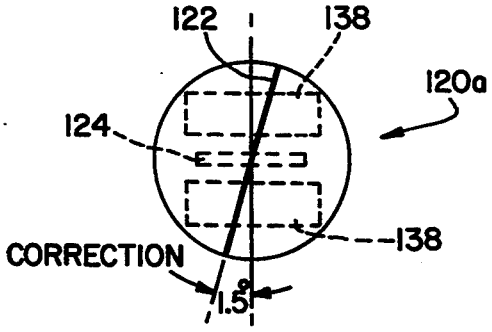
FIG. 7(*a*) and 7(*b*) are plan views of disks which are employed with the golf clubs of FIGS. 3–6 and 9(*a*) to 9(*c*).
Figure 7B:
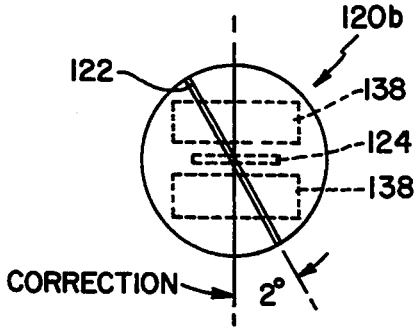

FIGS. 3–6 show a top view, a front elevational view, a side elevational view and a rear elevational view, respectively, of a golf club putter head 110 attached to a golf club shaft 111, of which only a small portion is depicted. The shaft 111 is a conventional shaft having an appropriate stiffness and is attached to hosel 116. In this embodiment, a cavity 112 preferably is formed for receiving a disk 120 (FIG. 7). The cavity 112 has the advantage of reducing the propensity of the disk 120 to remove itself from the golf club when the golf club is tested. Moreover, in this embodiment, an alignment key, which in this embodiment is formed by a groove 118 in the bottom of cavity 112 which mates with a key member 124 projecting from the bottom of disk 120, is provided to ensure that the disk 120 selected at the point of sale is correctly oriented on the putter head 110.

In the embodiment of FIGS. 1 and 2, to orient the indicia 22 on disk 20 properly with respect to the face 14 of the putter 10, a protractor-type tool may be used to ensure that the sight-line 20 is installed at the proper angle from the perpendicular to the face (in plan view) of the club in order to correctly compensate for the golfer's sighting error. Of course, errors can arise in such a task, especially if it has to be performed at a golf-pro shop or other retail outlet and, moreover, the disk may move if it is not affixed to the golf head 110. In the second embodiment of the invention, the groove 118 and key member 124 avoid human alignment errors which might otherwise occur when installing disk 120 on golf club 110 and to help keep the disk properly aligned while the club is being tested.

In accordance with this invention, a golfer's sighting error is either already known or must be measured. If it is not known, it may be measured using the apparatus disclosed in U.S. patent application Ser. No.3,826,495, or by other techniques. Then an appropriate disk 120 is selected and installed on golf club head 110. Disks 120 will normally be provided with varying amounts of compensation, for example, up to several degrees to either the right or left from the perpendicular to the face 14 of the golf club when viewed in plan view. If, for example, a golfer is tested for sighting error and is determined to have a 1.5° left correction requirement, a disk **120*a* having a 1.5° left correction factor built into it would be selected and temporarily installed on the golf club head 110** to permit the golfer who may have just had his or her sighting error checked, to actually test the golf club. See FIG. 7(*a*) If the golfer is determined to have a 2° right correction requirement, then a disk **120*b*** having a 2° right correction, as shown in FIG. 7(*b*) would be selected and temporarily installed on the golf club head for the golfer to test. (Note that the sighting lines 122 in FIGS. 7(*a*) and 7(*b*) are shown displaced from the normal or true sighting line by amounts greater than the nominal 1.5° and 2° for purposes of clarity of illustration. If a sale is subsequently consummated, then the disk 120 with the proper amount of correction factor associated with its indicia is permanently attached to golf club 110.

The disk 120 is preferably permanently attached to golf club 110 by means of suitable adhesive 138, and preferably by means of double-sided adhesive tape sold by 3M Corporation under the brand name Scotch TM VHB TM adhesive transfer tape. While the golf club is being tested, the disk 120 is simply placed in cavity 112, which makes it less likely for the disk to pop out while the golf club is being tested. If desired, the outside dimension of the disk 120 can be sized so that it has a slight interference fit with the inside dimension of cavity 112, so as to make the disk 120 even less likely to remove itself from the golf club during testing. If, during testing, it appears that the sighting line is not correctly oriented, the golf club can be returned to the pro shop or other point of sale for the purpose of trying a different correction. The disk 120 can be easily removed and replaced with a different disk having a different amount of correction associated with it. A disk having a given amount of correction is shown in FIG. 7, but any number of varying degrees or amounts of correction can be provided on different disks 120. Once a sale is consummated, adhesive 138 is affixed to the disk 120 having a sighting line 122 with the desired amount of correction and the disk 120 is then placed in cavity 112, mating key member 124 with groove 118.

The disks 120 are preferably marked with the amount of correction which their sighting lines 122 have so as to hopefully eliminate human error which might otherwise occur by selecting an incorrect disk 120.

Those skilled in the art will appreciate that the golfer's sighting error can be measured using an arbitrary scheme identifying the amount of correction, as opposed to stating the amount of correction in degrees. The amount of correction, however it is stated, should preferably be marked on the disks 120 and should agree with how the correction is measured.

In the embodiment of FIGS. 3–7, the groove and key members are shown as an elongated groove 118 and an elongated protrusion 124 which mate with each other. However, other means for ensuring that the disk 120 is properly placed on the golf club may be used. For example, non-circular disks may be employed which would tend to control the number of positions in which the disk could be installed, thereby helping to ensure the correct orientation of the sighting line 122 on the golf club when tested and/or sold. Also, instead of using a single elongated protrusion and groove arrangement, the protrusion can be formed as a series of points or any other configuration which would mate with corresponding indentation(s) on the golf club head 110.

Furthermore, instead of having protrusion(s) on the disk and receiving indentations on the golf club, the protrusion(s) can be provided on the golf club and the receiving indentations provided in the disk.

However, in practicing the present invention, it is preferred to provide the disk with an elongated protrusion 124 and the golf club with a protrusion receiving groove 118 for a number of reasons. First, it is believed that the apparatus can be more simply manufactured in that fashion. Second, when the aforementioned double-sided adhesive tape is used to affix the disk to the golf club, the double-sided adhesive tape 138 can be conveniently attached first to the bottom of the disk on either side of the elongated protrusion 124 before the disk is set into cavity 112. When the disk 120 is subsequently placed in cavity 112, it may need to be rotated slightly so as to align the elongated protrusion or key member 124 with groove 118 before it falls into place. At that time, the double-sided adhesive tape 138 will engage the flat areas on either side of groove 118 in the bottom of cavity 112 and thereby securely hold disk 120 in place.

As can be seen, the present invention permits a golf club pro-shop or other establishment which sells golf clubs to carry the same range of golf clubs which they have in the past, but each of the golf clubs can than be, in accordance with the present invention, equipped with a sight line 122 which corresponds to the particular sighting correction required by a golfer. All the establishment need do, in addition to carrying the golf clubs themselves, is to also have a supply of the disks 120 with a range of corrections. Since the disks are relatively small and relatively inexpensive, they are easy for an establishment to keep a supply on hand for the purposes of marketing sight-corrected golf clubs.

Third Embodiment of the Invention

Figure 8A:
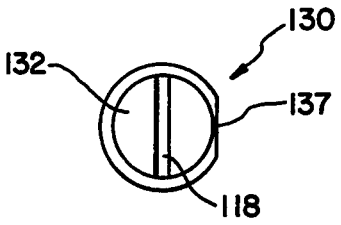
FIGS. 8(*a*), 8(*b*) and 8(*c*) are top elevational, side elevational and bottom elevational views, respectively of a sight alignment disk indexed used with a third embodiment of the invention.
Figure 8B:
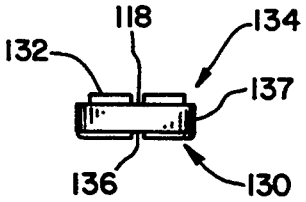
Figure 8C:
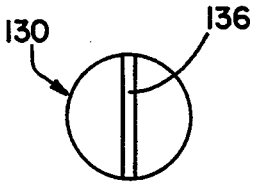
Figure 9A:
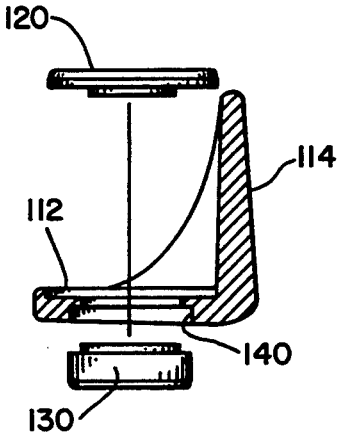
FIGS. 9(*a*), 9(*b*) and 9(*c*) are side sectional views through a putter head in accordance with a third embodiment of the invention showing it in various stages of manufacture and at the point of purchase.
Figure 9B:
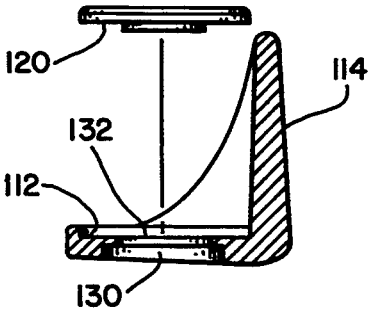
Figure 9C:
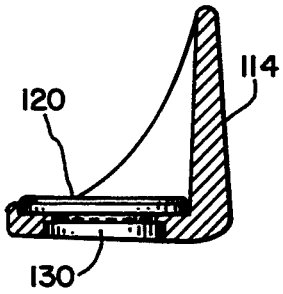

In accordance with the second embodiment of the invention, a cavity is defined in a golf club for receiving an alignment disk, with a cavity 112 having a groove 118 therein for receiving an alignment key on the bottom of the disk 120. However, manufacturing a golf club with such a groove is more easily said than done. This third embodiment of the invention is very similar to the second embodiment, but, may be easier to manufacture. This third embodiment differs from the second embodiment in that a sight alignment disk index 130 is provided which is affixed to the golf head at the time of manufacture. FIGS. 9(*a*)–9(*c*) are sectional views to a golf head which is otherwise similar to the embodiment of FIGS. 3–6, but in this case, instead of forming groove 118 in the bottom of cavity 112, the cavity is instead formed with the aid of a sight alignment disk index 130 which is shown in FIGS. 8(*a*)–8(*c*). FIG. 9(*a*) shows the putter during manufacture before the index 130 is attached to it. FIG. 9(*b*) shows the putter after the index 130 has been attached, excess material has been removed from the sole and thus shows the putter head as it would be delivered to a pro-shop or other point of sale. FIG. 9(*c*) shows the putter head with disk 120 attached at the point of sale.

The disk index 130 has a groove 118 formed into a top surface 132 thereof which will subsequently become part of the bottom surface of cavity 112 after the sight alignment disk index 130 is installed into a golf head, as will be seen. The alignment disk has a stepped collar at numeral 134 which makes it easy to control its vertical position within the golf head. The bottom surface of the disk index 130 is preferably also provided with a groove 136 and/or a flat surface 137 having a known alignment with groove 118. In FIG. 8(*b*), grooves 118 and 136 (and the flat surface 137) are shown as being in alignment with each other, but as those skilled in the art will soon come to appreciate, groove 136 or flat 137, if used during the manufacturing process, need only to have a known alignment with respect to groove 118.

FIGS. 9(*a*)–9(*c*) show three cross sections of a putter head taken through the center of cavity 112 at different stages of manufacture. In this embodiment, the bottom edge of the golf head has an opening 140 which aligns with cavity 112 and is sized to receive sight alignment disk index 130. Opening 140 is sized so as to create a stepped collar which corresponds to the collar 134 formed in the sight alignment disk index 130 so that surface 132 aligns with the bottom of cavity 112 when the index 130 is inserted in the putter head 10 as shown in FIG. 9(*b*). The index 130 may be made of any suitable material, but is preferably made of metal or plastic. It is fixed in place during the golf head manufacturing preferably by welding, if metal, or by a suitable adhesive, if plastic. It is preferably aligned during the manufacturing process by using either slot 136 or flat surface 137 (which ever is used) as an alignment device so as to appropriately align groove 118 with respect to ball-striking face 114 of the putter. In the embodiment of FIGS. 8(*a*)–8(*c*) and 9(*a*)–9(*c*), grooves 118 and 136 (and flat surface 137) are arranged such that an extension of those grooves (and of the side of the flat surface 137), as they penetrate the ball-striking surface 114 of the golf club in plan view, do so perpendicularly. They deviate somewhat from a true perpendicular to surface 114, due to the fact that the ball-striking surface 114 is conventionally tilted backwards somewhat (even with putters), to give the ball some loft when it is struck. But in plan view, in this embodiment, those grooves (and surface 137) appear perpendicular to the ball striking surface 114.

The bottom portion of index 130 and the sole of golf club are machined away after the index 130 has been welded into the golf club head, as is shown in FIGS. 9(*b*) and 9(*c*). If the index 130 is attached by adhesive, then it may only be necessary to machine away the index 130 alone. That is, if the index is attached by welding, it would make sense to also grind away part of the weld and sole materials to give the sole a nice finish. That may not be necessary if the index 130 is made of plastic. If the index 130 is welded into position, then the index 130 and opening 140 would be appropriately beveled to allow weld penetration to occur.

Figure 10A:
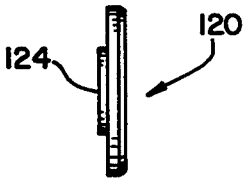
FIGS. 10 (*a*) and 10 (*b*) are side elevational views of the sight alignment disk used with the embodiment of FIGS. 3–6 and 9(*a*)–9(*c*)
Figure 10B:
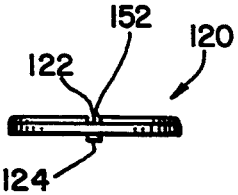
Figure 10C:
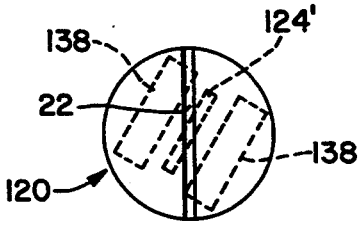
Figure 11:
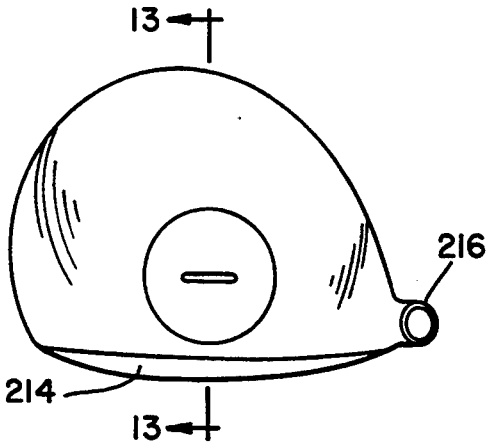
FIG. 11 is a top elevational view of the invention as used with a metal wood golf club, without a disk in place.
Figure 12:
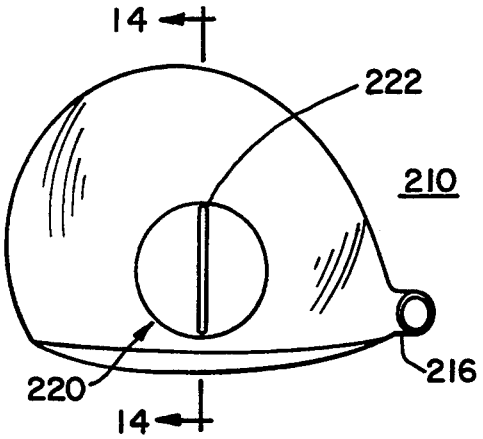
FIG. 12 is similar to FIG. 11, but with a disk in place.
Figure 13:
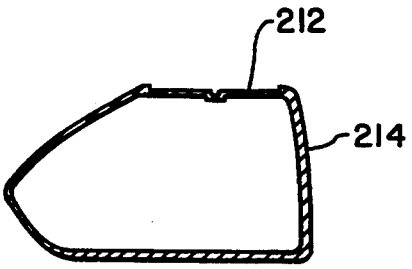
FIG. 13 is a sectional view taken through the golf club depicted in FIG. 11.
Figure 14:
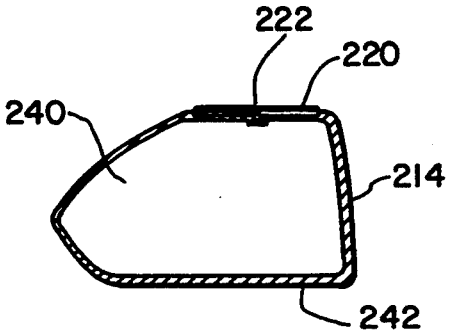
FIG. 14 is a sectional view through golf club of FIG. 12, but with the disk shown in side view.
Figure 15:
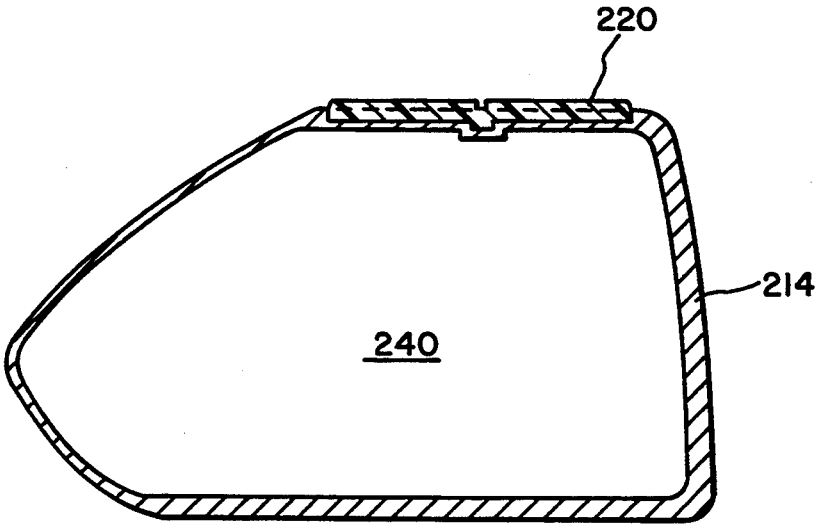
FIG. 15 is an enlarged sectional view corresponding to FIG. 14, but wherein the disk is also shown in section.

The sight alignment disk 120 is shown in detail in Figures 10(*a*), 10(*b*) and 10(*c*). It is shown installed on the golf club 110 in FIG. 9(*c*) as it would be at the point of sale. In FIG. 10(*b*), the sighting line indicia 122 is formed by means of a groove 152 in the top surface of disk 120. Those skilled in the art will appreciate, of course, that groove 152 could be filled with a contrasting color of material, if desired, or that the sighting line could be identified by other means on the surface of disk 120 than using a groove. In FIG. 10(*b*), the indicia 122 is shown in alignment with the key member 124. Of course, such an alignment disk would be proper for a golfer exhibiting no or very, very little sighting error. Of course, many golfers have an appreciable sighting error, which means that key member 124 would be disposed at some angle to indicia 122, such as the key member 124, shown in phantom line in FIG. 10(*b*). The aforementioned double sided adhesive tape would preferably be applied on surface 132, that is, on either side of key member 124, before the disk 120 is placed in cavity 112.

As previously described, disks having varying amounts of correction associated with them, that is with the key member 124 being formed at different angles relative to indicia 122 would be manufactured with the amount of correction identified on the disk 120 and provided to the pro-shops or other retail outlets so that a disk 120 having the proper amount of correction associated for the purchasing golfer can be installed on the golf head at the point of sale easily and conveniently in accordance with the present invention. FIG. 9(*c*) shows disk 120 affixed on the golf head at the point of purchase.

Fourth Embodiment of the Invention

As indicated above, the invention can be used to other golf clubs, besides putters. The application of the invention to a metal wood is shown in FIGS. 11–14. The metal wood has a hollow interior 240 which is usually filled with a foamed material so as to deaden the club and to give it proper weight. Those constructural details are well known in the art and not particularly relevant to the present invention. As in the case of the putter, the metal wood 210 has a relatively flat surface 212 extending rearwardly from the ball striking surface 214. As disk 220 is provided which has a sight line 222 inscribed or otherwise marked thereon which is mounted on surface 212, preferably at the point of sale of the metal wood. As in the case of the previously described embodiments, the sighting lines 222 would usually be disposed at some angle from the perpendicular to a tangent at face 214. As is normal for woods, the face 214 is slightly rounded. The particular angle by which line 212 would deviate from that perpendicular would correspond to that which is needed to compensate for the golfers sighting error as previously described. The disk 220 is secured to surface 212 by means of a suitable adhesive medium, preferably, the previously described double-sided adhesive tape.

Having described the invention, modification will now suggest itself to those skilled in the art. For example, the disk 120 can be attached to the golf club head by using a suitable adhesive, instead of a double-sided tape previously mentioned herein. Moreover, as has been previously mentioned herein, it is believed that the present invention is quite suitable for use in the context of attaching the disk 20 or 120 to the golf club head at the point of sale. In that way, the number of golf clubs which must be stocked at the point of sale is reduced. However, others practicing the instant invention may prefer to attach the disk 20 or 120 before the golf clubs are shipped to the point of sale. Additionally, the instant invention has been described with reference to a golf club putter, but those skilled in the art will appreciate that the instant invention can be used with golf clubs other than putters. The correction factors mentioned in the specification have been mentioned in terms of degrees, but the correction factors could be expressed in any arbitrary units or even by colors or other methods of demarcation, so long as they are correlated with whatever apparatus is used to measure the golfers citing error. For these and other reasons, the invention is not to be limited to the disclosed embodiments, except as required by the appended claims.

What is claimed is:

1. A system for providing a golfer with a golf club having a sighting line which compensates for said golfer's natural lateral sighting error with respect to a desired direction for striking a golf ball, said system comprising:

(a) a golf head;

(b) at least one module bearing said sighting line thereon, said sighting line being intended to compensate for a golfer's natural sighting error to either lateral side of said desired direction;

(c) a region on said golf head adapted for receiving said at least one module so that said at least one module may be releasably engaged on said golf head,.whereby a golfer may insert a first module and test the golf club to determine whether the sighting line on said first module adequately compensates for said golfer's natural lateral sighting error, whereby said golfer may remove said first module and replace it with a second module having its sighting line disposed at an angle from the desired direction which is different from the angle that the sighting line on said first module is disposed from the desired direction and test the golf club to determine whether the sighting line on said second module adequately compensates for said golfer's natural lateral sighting error, and whereby said golfer may continue to remove and replace modules until the module having the sighting line providing adequate correction for said golfer's natural lateral sighting error is found; and (d) means for securing said module having the sighting line providing adequate correction for said golfer's natural lateral sighting error to said golf head.

2. The system of claim 1, wherein said region comprises a cavity in said golf head.

3. The system of claim 2, wherein said cavity is formed by an opening through said golf head which is partially plugged by an index disk during manufacture.

4. The system of claim 3, wherein said index disk has a substantially planar top surface, wherein said top surface has a groove formed therein, and wherein when said index disk is installed in said golf head said top surface of said index disk provides a floor of said cavity.

5. The system of claim 4, wherein each of said modules is an alignment disk having a substantially planar top and a substantially planar bottom, said sighting line being provided on said planar top and said disk further including a projection on said planar bottom which is adapted to mate with the groove in said top surface of said index disk, which top surface is the floor of said cavity.

6. The system of claim 1, wherein said region is defined by a cavity in said golf head and said module is adapted for disposition in said cavity.

7. The system of claim 6, wherein said modules and cavity have keying means for assuring proper alignment of said alignment indicia relative to a golf ball striking surface of said golf head.

8. A method for making a golf club which provides correction for a golfer's natural lateral sighting error with respect to a desired direction for striking a golf ball, said method comprising the steps of:

(a) providing a first alignment compensating module, each module bearing thereon a sighting line intended to compensate for said golfer's natural lateral sighting error;

(b) providing a golf club having a golf head having a region adapted for releasably receiving each module;

(c) inserting said first module and having said golfer test the golf club to determine whether the sighting line on said first module adequately compensates for said golfer's natural lateral sighting error;

(d) removing said first module and replacing it with a second module having its sighting line disposed at an angle from the desired direction which is different from the angle that the sighting line on said first module is disposed from the desired direction and having said golfer test the golf club to determine whether the sighting line on said second module adequately compensates for said golfer's is natural lateral sighting error;

(e) continuing to remove and replace modules until the module having a sighting line providing adequate correction for said golfer's natural lateral sighting error is found; and (f) securing said module having the sighting line providing adequate correction for said golfer's natural lateral sighting error to said golf head.

9. The method of claim 8 comprising the additional steps of forming a key member on said modules and an indentation in said region corresponding to said key member, whereby said sighting line remains in place during the testing of said golf club.

* * * * *